US005484318A

United States Patent [19]

Mayert et al.

[11] Patent Number: 5,484,318

[45] Date of Patent: Jan. 16, 1996

[54] STRESS REDUCTION KIT

[76] Inventors: Todd M. Mayert; Curtis Mayert, both of 2613 20th Street SW, Calgary, Alberta, Canada, T2T 4Z4

[21] Appl. No.: 400,744

[22] Filed: Mar. 6, 1995

[51] Int. Cl.[6] ..... A63H 33/00

[52] U.S. Cl. ..... 446/75; 446/81; 446/397; 446/491; 428/178

[58] Field of Search ..... 446/75, 81, 397, 446/491; 434/236; 428/178, 166

[56] References Cited

U.S. PATENT DOCUMENTS

| | | | |
|---|---|---|---|
| 2,221,310 | 11/1940 | Gazelle | 428/178 |
| 4,378,391 | 3/1983 | Allen | 40/427 |
| 4,911,671 | 3/1990 | Rogers | 446/397 |
| 5,083,961 | 1/1992 | Ishiwa | 446/75 |

FOREIGN PATENT DOCUMENTS

| | | | |
|---|---|---|---|
| 2065548 | 7/1981 | United Kingdom | 428/178 |
| 2225536 | 6/1990 | United Kingdom | 446/491 |

*Primary Examiner*—Robert A. Hafer
*Assistant Examiner*—Jeffrey D. Carlson

[57] ABSTRACT

A novelty stress reduction kit including a container having a hollow interior and an opening for allowing access to the interior; a lid securable over the opening of the container; a set of sheets of bubble-type packing material, each sheet having a plurality of hand-burstable air-filled bubbles formed thereon, the sheets of the set positionable in stacked relation to define a deck and with the deck snugly positionable within the interior of the container with the lid closeable thereover, the set of sheets including a plurality of subsets of sheets and with the subsets of sheets each having different characteristic colors; a color-coded instruction sheet affixed to the cover with the instruction sheet associating a color of a subset of sheets with a description of a type of stress, whereby a user determines the type of stress currently being experienced and notes the associated color, selects a sheet with the same color as the noted color, and then bursts the bubbles on the sheet for relieving the stress.

6 Claims, 4 Drawing Sheets

FIG 1
PRIOR ART
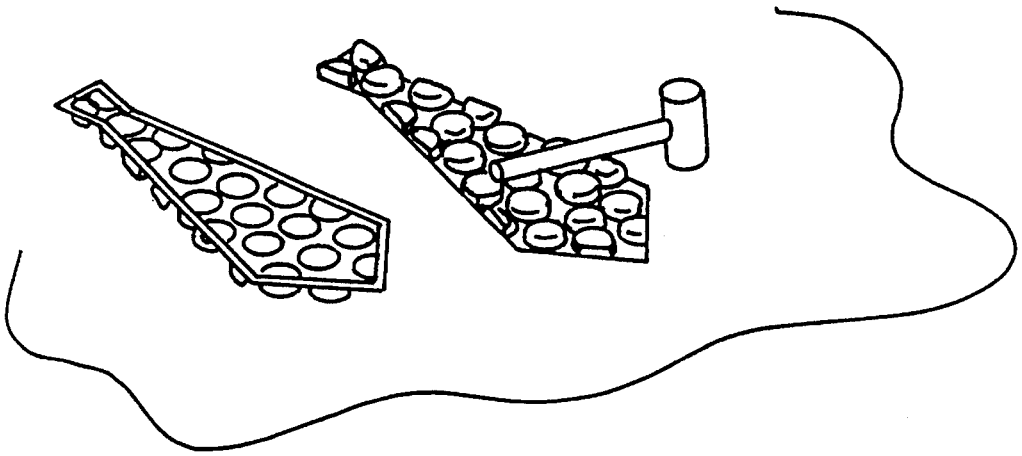
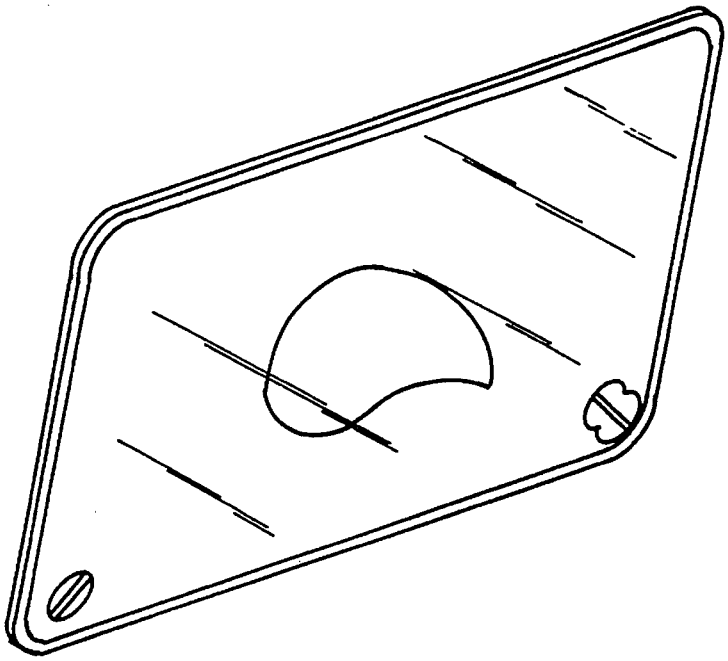
FIG 2
PRIOR ART

STRESS REDUCTION KIT

BACKGROUND OF THE INVENTION

1. Field of the Invention

The present invention relates to a novelty stress reduction kit and more particularly pertains to allowing a user to relieve stress and for providing a source of whimsical entertainment with a novelty stress reduction kit.

2. Description of the Prior Art

The use of novelty stress reduction apparatuses is known in the prior art. More specifically, novelty stress reduction apparatuses heretofore devised and utilized for the purpose of reducing stress or providing a whimsical appearance of reducing stress are known to consist basically of familiar, expected and obvious structural configurations, notwithstanding the myriad of designs encompassed by the crowded prior art which have been developed for the fulfillment of countless objectives and requirements.

By way of example, U.S. Pat. Des. No. 251,607 to Weller discloses a visual input stress aid kit. U.S. Pat. Des. No. 331,012 to Karita et al. discloses a blister package. U.S. Pat. No. 3,645,384 to Wind discloses a single-piece blister package. U.S. Pat. No. 4,499,353 to Shields discloses a blister package. U.S. Pat. No. 4,911,671 to Rogers discloses a novelty kit and method for using it to relieve tension and stress.

While these devices fulfill their respective, particular objective and requirements, the aforementioned patents do not describe a novelty stress reduction kit that allows a user to relieve stress and provides a whimsical source of entertainment through the bursting of bubbles on bubble-wrap packing material.

In this respect, the novelty stress reduction kit according to the present invention substantially departs from the conventional concepts and designs of the prior art, and in doing so provides an apparatus primarily developed for the purpose of allowing a user to relieve stress and for providing a source of whimsical entertainment.

Therefore, it can be appreciated that there exists a continuing need for new and improved novelty stress reduction kit which can be used for allowing a user to relieve stress and for providing a source of whimsical entertainment. In this regard, the present invention substantially fulfills this need.

SUMMARY OF THE INVENTION

In the view of the foregoing disadvantages inherent in the known types of novelty stress reduction apparatuses now present in the prior art, the present invention provides an improved novelty stress reduction kit. As such, the general purpose of the present invention, which will be described subsequently in greater detail, is to provide a new and improved novelty stress reduction kit and method which has all the advantages of the prior art and none of the disadvantages.

To attain this, the present invention essentially comprises, in combination, a rigid square box-shaped container having a planar bottom wall and four planar side walls extended upwards from the periphery of the bottom wall to define a hollow interior and a top edge bounding an opening to the interior. A rigid square planar lid is included and hingeably coupled to the container. The lid has an upper surface, a lower surface, and a periphery interconnecting the surfaces. The lid is positionable over the opening and in contact with the top edge of the container for preventing access therein and further positionable away from the opening for allowing such access.

A set of square sheets of bubble-type packing material is included. The sheets are positionable in stacked registered relation to define a deck and with the deck snugly positionable within the interior of the container with the lid closeable thereover. The set includes a first subset, a second subset, and a third subset of sheets. The sheets of the first subset are each formed of plastic having a blue characteristic color. The sheets of the second subset are each formed of plastic having a green characteristic color and a resilience greater than the sheets of the first subset. Furthermore, the sheets of the third subset are formed of a plastic having a red characteristic color and a resilience greater than the sheets of the second subset. Each sheet of the set has a plurality of hand-burstable air-filled bubbles formed thereon positioned in sequences of rows and with each bubble thereon having a generally horizontal circular cross-section. Each bubble on the sheets of the first subset has a diameter less than those on the sheets of the second subset. Each bubble on the sheets of the second subset has a diameter less than those on the sheets of the third subset. A square instruction sheet is included and has an upper surface and a lower surface. The lower surface of the instruction sheet has a layer of adhesive applied thereto. The lower surface of the instruction sheet is adhered to the lower surface of the lid. The instruction sheet bears three rectangles thereon with one rectangle having a blue characteristic color, another rectangle having a green characteristic color, and the remaining rectangle having a red characteristic color. The rectangles define a color-code indication. The instruction sheet further bears a paragraph associated with each colored rectangle thereon describing a type of stress.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved novelty stress reduction kit which has all the advantages of the prior art novelty stress reduction apparatuses and none of the disadvantages.

It is another object of the present invention to provide a new and improved novelty stress reduction kit which may be easily and efficiently manufactured and marketed.

It is a further object of the present invention to provide a new and improved novelty stress reduction kit which is of durable and reliable construction.

An even further object of the present invention is to provide a new and improved novelty stress reduction kit which is susceptible of a low cost of manufacture with regard to both materials and labor, and which accordingly is then susceptible of low prices of sale to the consuming public, thereby making such a novelty stress reduction kit economically available to the buying public.

Still yet another object of the present invention is to provide a new and improved novelty stress reduction kit which provides in the apparatuses and methods of the prior art some of the advantages thereof, while simultaneously overcoming some of the disadvantages normally associated therewith.

Even still another object of the present invention is to provide a new and improved novelty stress reduction kit for allowing a user to relieve stress and for providing a source of whimsical entertainment.

Lastly, it is an object of the present invention to provide a new and improved novelty stress reduction kit comprising a container having a hollow interior and an opening for allowing access to the interior; a lid securable over the opening of the container; a set of sheets of bubble-type packing material, each sheet having a plurality of hand-burstable air-filled bubbles formed thereon, the sheets of the set positionable in stacked relation to define a deck and with the deck snugly positionable within the interior of the container with the lid closeable thereover, the set of sheets including a plurality of subsets of sheets and with the subsets of sheets each having different characteristic colors; a color-coded instruction sheet affixed to the cover with the instruction sheet associating a color of a subset of sheets with a description of a type of stress, whereby a user determines the type of stress currently being experienced and notes the associated color, selects a sheet with the same color as the noted color, and then bursts the bubbles on the sheet for relieving the stress.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a prior art novelty kit for relieving tension and stress.

FIG. 2 is a perspective view of prior art visual input stress aid kit.

The same reference numerals refer to the same parts through the various Figures.

DESCRIPTION OF THE PREFERRED EMBODIMENT

Figure 3:
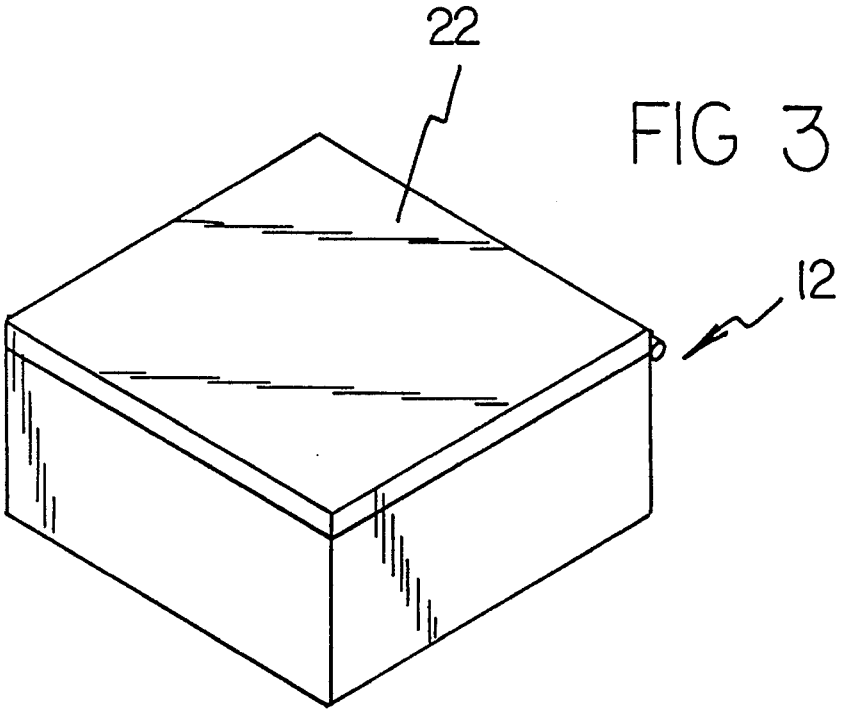
FIG. 3 is a perspective view of the container of the present invention with its lid shut.

With reference now to the drawings, and in particular, to FIGS. 2 and 3 thereof, the preferred embodiment of the new and improved novelty stress reduction kit embodying the principles and concepts of the present invention will be described.

The present invention is comprised of a plurality of components. In their broadest context, such components include a container and bubble-type packing material. Such components are individually configured and correlated with respect to each other to provide the intended function of allowing a user to relieve stress and for providing a source of whimsical entertainment.

Specifically, the present invention includes a rigid square box-shaped container 12. The container has a planar bottom wall 14 and four planar side walls 16 extended upwards from the periphery thereof. In this configuration, a hollow interior is defined and a top edge 18 bounding an opening to the interior.

Figure 4:
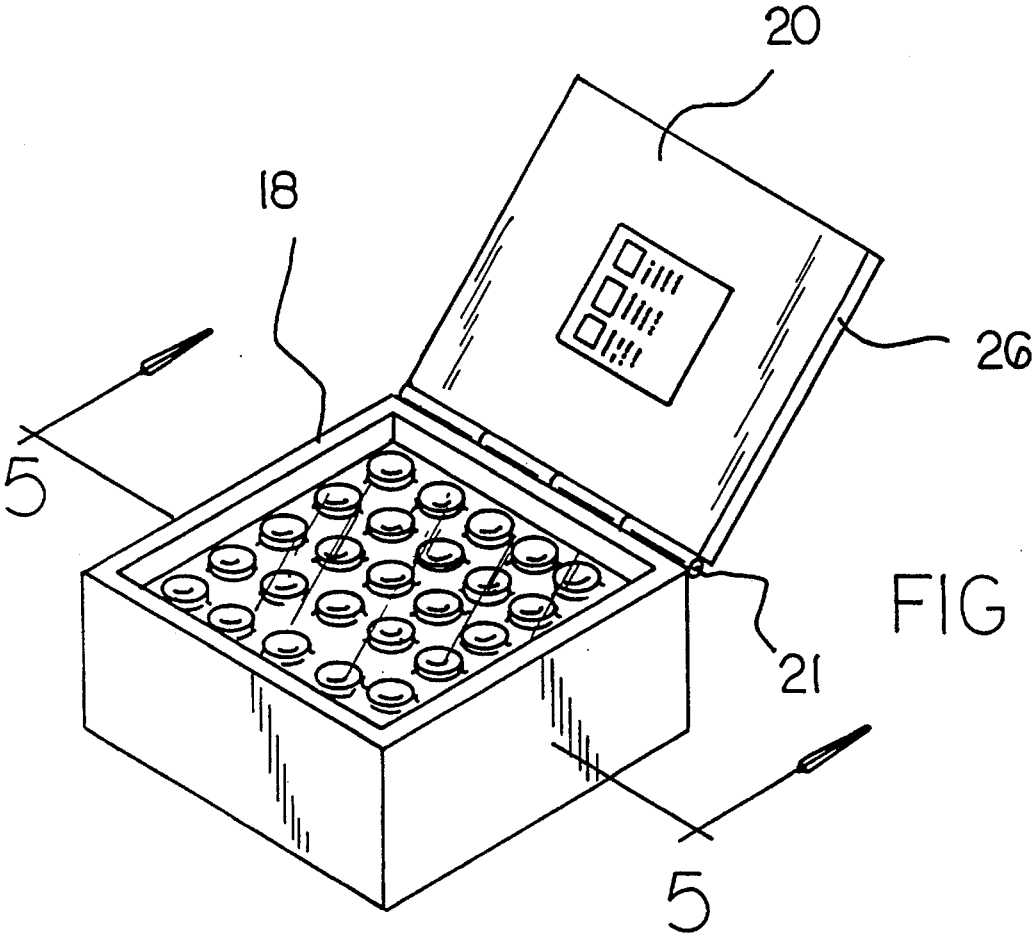
FIG. 4 is a perspective view of the preferred embodiment constructed in accordance with the principles of the present invention with its lid open for use.

Also provided is a lid 20. The lid is rigid, square, and planar in structure. It is coupled to the container with a hinge 21 along one common side. The lid has an upper surface 22, a lower surface 24, and a periphery interconnecting the surfaces 26. The lid is positionable over the opening and in contact, with the top edge of the container for preventing access therein as shown in FIG. 3. Furthermore, the lid is positionable away from the opening for allowing such access as shown in FIG. 4.

Figure 5:
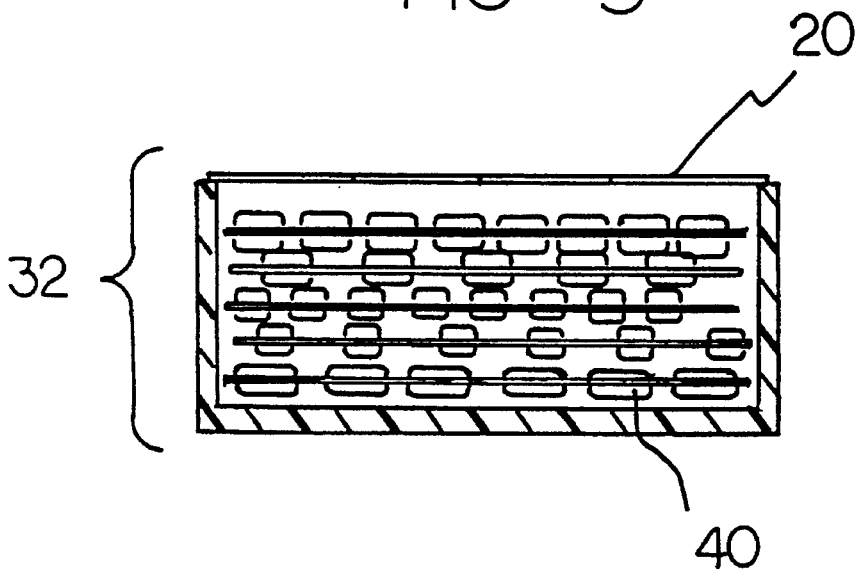
FIG. 5 is a cross-sectional view of the present invention taken along the line 5—5 of FIG. 4.
Figure 6:
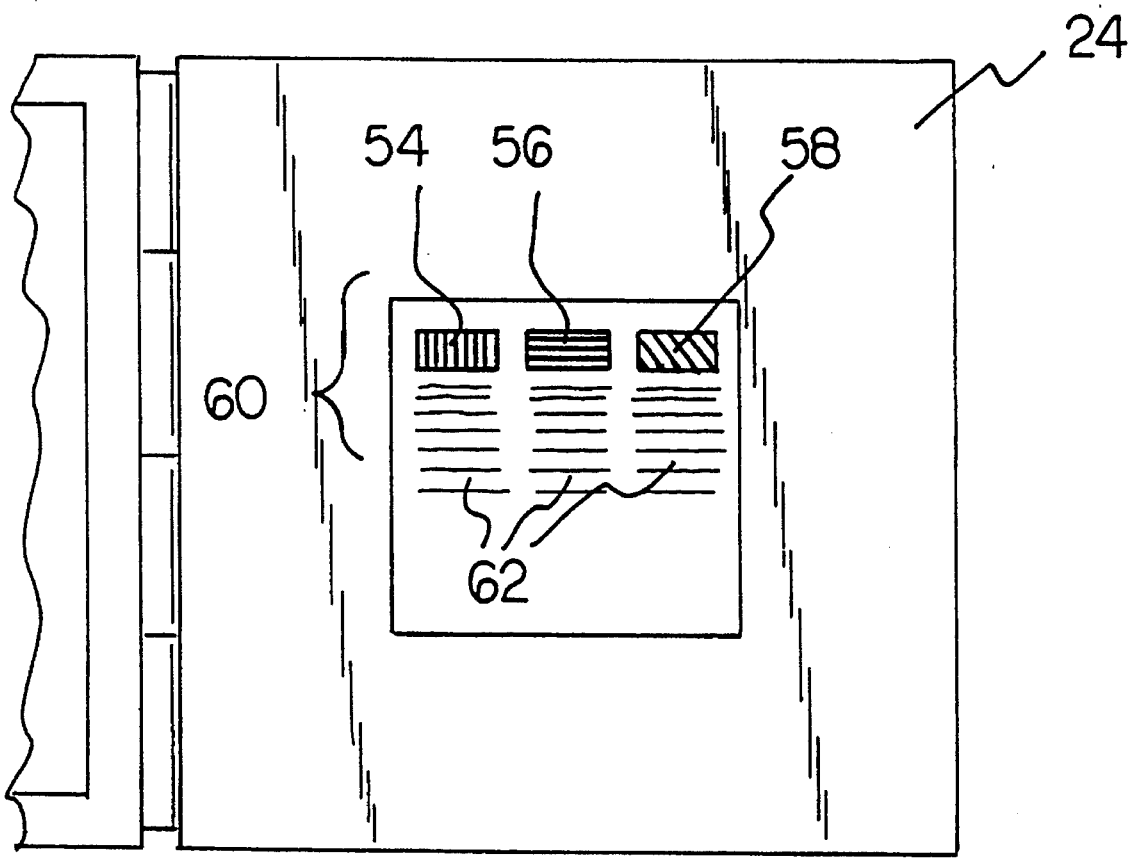
FIG. 6 is an enlarged plan view of the instruction sheet of the present invention and its securement to the lid.
Figure 7:
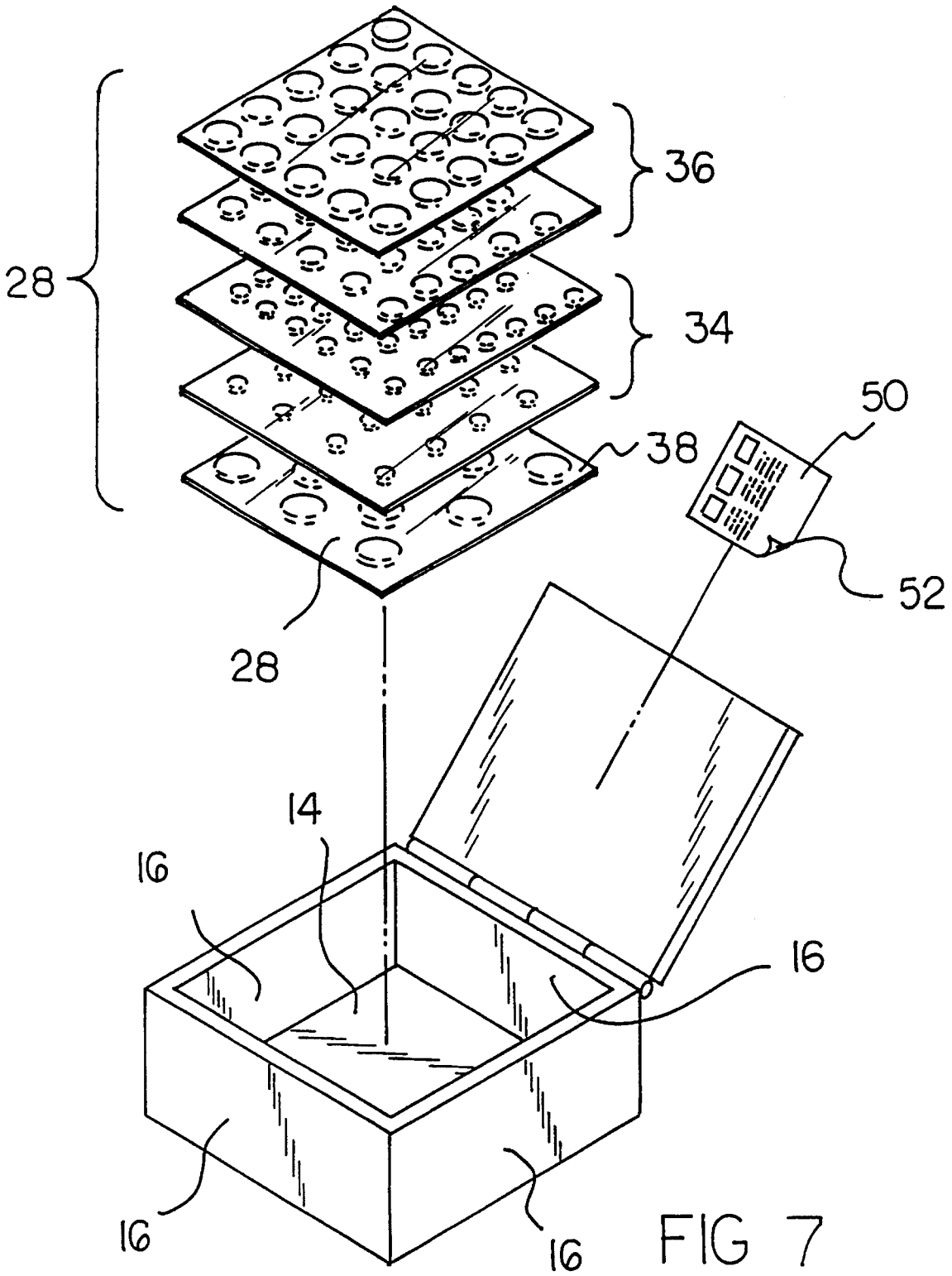
FIG. 7 is an exploded perspective view of the present invention.

Also provided is a set 28 of square sheets of bubble-type packing material. The sheets are positionable in a stacked registered relation to define a deck 32. The deck is snugly positionable within the interior of the container as shown in FIGS. 5 and 6. The lid is closable over the deck. The sets of sheets include a first subset 34, a second subset 36, and a third subset 38 of sheets. The sheets of the first subset are each formed of a plastic having a blue characteristic color. The sheets of the second subset are each formed of a plastic having a green characteristic color and a resilience greater than the sheets of the first subset. Lastly, the sheets of the third subset are each formed of a plastic having a red characteristic color and a resilience greater than the sheets of the second subset. Each sheet of the set has a plurality of hand-burstable burstable air-filled bubbles 40 formed thereon in sequences of rows. Some of the rows on a sheet have less bubbles than the corresponding adjacent rows on the sheet. Each bubble on the sheet has a generally horizontal circular cross-section. Each bubble on the sheets of the first subset has a diameter less than those on the sheets of the second subset. Each bubble on the sheets of the second subset has a diameter less than those on the sheets of the third subset.

To operate the present invention an instruction sheet 50 is provided. The instruction sheet is formed of a flexible paper-like material and is square in structure. The instruction sheet has an upper surface and a lower surface. The lower surface has a layer of adhesive 52 applied thereto. The lower surface of the instruction sheet is adhered to the lower surface of the lid. The instruction sheet bears three columns thereon. Each column has a rectangle formed thereon. One rectangle 54 has a blue characteristic color. Another rectangle 56 has a green characteristic color. The remaining rectangle 58 has a red characteristic color. The rectangles define a color-code indication 60. The instruction sheet further bears a paragraph 62 associated with each colored rectangle. This paragraph is positioned directly below the associated rectangle. The paragraph describes a type of stress associated with the corresponding color of the rectangle. After a user determines the type of stress currently being experienced and notes the associated color, the user then selects a sheet with the same color as the noted color. Now, a user may burst the bubbles on the sheet for relieving the particular stress.

The present invention is a novelty item whose purpose is to relieve stress and provide entertainment. The present invention makes use of plastic packing bubbles normally used to prevent damage to items being shipped or stored. The present invention is intended primarily for office workers, but can be used by anyone who is under stress.

The present invention consists of a number of square sheets of plastic bubbles. These sheets come stacked on top of one another in a wooden or plastic box measuring about 6 inches square. There are between about 5 to 8 sheets per box. The box has a lid that is hinged at the back, and there is a color-coded instruction sheet attached to the lower surface of the lid. The strip or instruction sheet displays small patches of three different colors such as blue, green, and green. Beside each patch of color is a description of which color corresponds to a particular type of stress. The colors on the color-coding strip correlate to the colors of the sheets of plastic bubbles.

If a user is stressed, he or she simply grabs some bubbles corresponding to the type of stress and begins popping them. This diverts the user's attention from the particular problems causing the stress and provides a pleasant activity to pursue while the user works on the problems.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A novelty stress reduction kit for allowing a user to relieve stress and for providing a source of whimsical entertainment comprising, in combination:

a rigid square box-shaped container having a planar bottom wall and four planar side walls extended upwards from the periphery of the bottom wall to define a hollow interior and a top edge bounding an opening to the interior;

a rigid square planar lid hingeably coupled to the container, the lid having an upper surface, a lower surface, and a periphery interconnecting the surfaces, the lid positionable over the opening and in contact with the top edge of the container for preventing access therein and further positionable away from the opening for allowing such access;

a set of square sheets of bubble-type packing material, the sheets positionable in stacked registered relation to define a deck and with the deck snugly positionable within the interior of the container with the lid closeable thereover, the set of sheets including a first subset, a second subset, and a third subset of sheets, the sheets of the first subset each formed of plastic having a first characteristic color, the sheets of the second subset each formed of plastic having a second characteristic color and a resilience greater than the sheets of the first subset, and the sheets of the third subset formed of a plastic having a third characteristic color and a resilience greater than the sheets of the second subset, each sheet of the set having a plurality of hand-burstable air-filled bubbles formed thereon in sequences of rows and with each bubble thereon having a generally horizontal circular cross-section, each bubble on the sheets of the first subset having a diameter less than those on the sheets of the second subset, each bubble on the sheets of the second subset having a diameter less than those on the sheets of the third subset;

a square instruction sheet having an upper surface and a lower surface with a layer of adhesive applied thereto and with the lower surface adhered to the lower surface of the lid, the instruction sheet bearing three rectangles with one rectangle having a first characteristic color, another rectangle having a second characteristic color, and the remaining rectangle having a third characteristic color and with the rectangles defining a color code indication, the instruction sheet further bearing a paragraph associated with each colored rectangle describing a type of stress, whereby a user determines the type of stress currently being experienced and notes the associated color, selects a sheet with the same color as the noted color, and then bursts the bubbles on the sheet for relieving the stress.

2. The novelty stress reduction kit as set forth in claim 1 wherein the first characteristic color is blue, the second characteristic color is green, and the third characteristic color is red.

3. A novelty stress reduction kit comprising:

a container having a hollow interior and an opening for allowing access to the interior;

a lid securable over the opening of the container;

a set of sheets of bubble-type packing material, each sheet having a plurality of hand-burstable air-filled bubbles formed thereon, the sheets of the set positionable in stacked relation to define a deck and with the deck snugly positionable within the interior of the container with the lid closeable thereover, the set of sheets including a plurality of subsets of sheets and with the subsets of sheets each having different characteristic colors;

a color-coded instruction sheet associating a color of a subset of sheets with a description of a type of stress, whereby a user determines the type of stress currently being experienced and notes the associated color, selects a sheet with the same color as the noted color, and then bursts the bubbles on the sheet for relieving the stress.

4. The novelty stress reduction kit as set forth in claim 3 wherein the set is formed of a first subset, a second subset, and a third subset of sheets, the sheets of the first subset each having a blue characteristic color, the sheets of the second subset each having a green characteristic color and the sheets of the third subset having a red characteristic color.

5. The novelty stress reduction kit as set forth in claim 3 wherein the plastic of a given subset of sheets has characteristic resilience that is different than the resilience of the plastic of the remaining subsets of sheets.

6. The novelty stress reduction kit as set forth in claim 3, wherein the bubbles of a given subset of sheets have a characteristic size that is different than the sizes of the bubbles on the remaining subsets of sheets.

* * * * *